US008447595B2

(12) United States Patent
Chen

(10) Patent No.: US 8,447,595 B2
(45) Date of Patent: May 21, 2013

(54) ECHO-RELATED DECISIONS ON AUTOMATIC GAIN CONTROL OF UPLINK SPEECH SIGNAL IN A COMMUNICATIONS DEVICE

(75) Inventor: Shaohai Chen, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 378 days.

(21) Appl. No.: 12/793,360

(22) Filed: Jun. 3, 2010

(65) Prior Publication Data

US 2011/0301948 A1 Dec. 8, 2011

(51) Int. Cl.
*G10L 19/14* (2006.01)

(52) U.S. Cl.
USPC ..... 704/225; 704/224; 704/226; 704/227; 370/287; 370/289; 370/290; 381/66; 381/91; 381/122; 455/246.1; 455/570; 379/406.1

(58) Field of Classification Search
USPC ..... 704/225
See application file for complete search history.

(56) References Cited

U.S. PATENT DOCUMENTS 4,514,703 A * 4/1985 Maher et al. ..... 330/279
5,016,271 A * 5/1991 Ford ..... 379/406.15
5,099,472 A * 3/1992 Townsend et al. ..... 370/291
5,548,616 A * 8/1996 Mucke et al. ..... 375/295
5,566,201 A * 10/1996 Ostman ..... 375/130
5,809,463 A * 9/1998 Gupta et al. ..... 704/233
5,901,234 A * 5/1999 Sonohara et al. ..... 381/104
5,907,823 A * 5/1999 Sjoberg et al. ..... 704/225
6,148,078 A * 11/2000 Romesburg ..... 379/406.07
6,169,971 B1 1/2001 Bhattacharya
6,212,273 B1 * 4/2001 Hemkumar et al. ..... 379/406.08
6,363,343 B1 3/2002 Horos
6,453,289 B1 * 9/2002 Ertem et al. ..... 704/225
6,487,178 B1 * 11/2002 Romesburg et al. ..... 370/286
6,526,139 B1 * 2/2003 Rousell et al. ..... 379/406.03
6,563,803 B1 * 5/2003 Lee ..... 370/290
6,618,701 B2 9/2003 Piket et al.
6,771,701 B1 * 8/2004 Klindworth et al. ..... 375/232
6,804,203 B1 * 10/2004 Benyassine et al. ..... 370/286
6,912,209 B1 * 6/2005 Thi et al. ..... 370/286
7,155,385 B2 * 12/2006 Berestesky et al. ..... 704/215
7,231,234 B2 * 6/2007 Awad et al. ..... 455/570
7,379,866 B2 * 5/2008 Gao ..... 704/220
7,433,462 B2 * 10/2008 Hodges et al. ..... 379/388.06
7,440,891 B1 * 10/2008 Shozakai et al. ..... 704/233
7,464,029 B2 12/2008 Visser et al.
7,555,117 B2 * 6/2009 Suppappola et al. .... 379/406.08

(Continued)

OTHER PUBLICATIONS

Archibald, Fitzgerald J., "Software Implementation of Automatic Gain Controller for Speech Signal", Texas Instruments, White Paper, SPRAAL1—Jul. 2008, (pp. 1-16).

(Continued)

*Primary Examiner* — Pierre-Louis Desir
*Assistant Examiner* — Fariba Sirjani
(74) *Attorney, Agent, or Firm* — Blakely, Sokoloff, Taylor & Zafman LLP

(57) ABSTRACT

A method for performing a call between a near-end user and a far-end user, which includes the following operations performed during the call by the near-end user's communications device. Automatic gain control (AGC) is performed to update a gain applied to an uplink speech signal. A frame is detected in a downlink signal that contains speech; in response, the updating of the gain is frozen. Other embodiments are also described and claimed.

14 Claims, 3 Drawing Sheets

U.S. PATENT DOCUMENTS

| | | | | |
|---|---|---|---|---|
| 7,558,729 | B1 * | 7/2009 | Benyassine et al. | 704/226 |
| 7,630,887 | B2 * | 12/2009 | Erell | 704/225 |
| 7,773,691 | B2 * | 8/2010 | Khlat et al. | 375/296 |
| 8,204,742 | B2 * | 6/2012 | Yang et al. | 704/209 |
| 8,306,215 | B2 * | 11/2012 | Takada | 379/406.08 |
| 2002/0044666 | A1 * | 4/2002 | Eran et al. | 381/66 |
| 2003/0228023 | A1 * | 12/2003 | Burnett et al. | 381/92 |
| 2003/0235312 | A1 * | 12/2003 | Pessoa et al. | 381/66 |
| 2005/0004796 | A1 * | 1/2005 | Trump et al. | 704/225 |
| 2006/0018457 | A1 * | 1/2006 | Unno et al. | 379/388.04 |
| 2006/0018460 | A1 * | 1/2006 | McCree | 379/406.08 |
| 2006/0217974 | A1 * | 9/2006 | Sukkar et al. | 704/225 |
| 2006/0247927 | A1 * | 11/2006 | Robbins et al. | 704/225 |
| 2007/0121021 | A1 * | 5/2007 | Kaehler et al. | 349/12 |
| 2008/0161064 | A1 * | 7/2008 | Lewis et al. | 455/567 |
| 2009/0010452 | A1 * | 1/2009 | Unno et al. | 381/94.1 |
| 2009/0010453 | A1 * | 1/2009 | Zurek et al. | 381/94.5 |
| 2009/0070106 | A1 * | 3/2009 | Gao et al. | 704/225 |
| 2009/0281803 | A1 * | 11/2009 | Chen et al. | 704/226 |
| 2010/0017205 | A1 * | 1/2010 | Visser et al. | 704/225 |
| 2010/0086122 | A1 * | 4/2010 | Takada | 379/406.08 |
| 2011/0066428 | A1 * | 3/2011 | Yang et al. | 704/225 |
| 2012/0065967 | A1 * | 3/2012 | Ohkawa | 704/225 |
| 2012/0101816 | A1 * | 4/2012 | Erell | 704/225 |

OTHER PUBLICATIONS

Pérez, J.P. Alegre, et al., "Automatic Gain Control", Analog Circuits and Signal Processing, Techniques and Architectures for RF Receivers, Chapter 2 AGC Fundamentals, 2011, DOI 10.1007/978-1-4614-0167-4_2, ISBN: 978-1-4614-0166-7, pp. 13-28.

* cited by examiner

ECHO-RELATED DECISIONS ON AUTOMATIC GAIN CONTROL OF UPLINK SPEECH SIGNAL IN A COMMUNICATIONS DEVICE

An embodiment of the invention relates to automatic gain control techniques applied to an uplink speech signal within a communications device such as a smart phone or a cellular phone. Other embodiments are also described.

BACKGROUND

In-the-field of mobile communications using devices such as a smart phones and cellular phones, there are many audio signal processing operations that can impact how well a far-side user hears a conversation with a mobile phone user. For instance, there is active noise cancellation, which is an operation that estimates or detects such background noise, and then adds an appropriate anti-noise signal to an "uplink" speech signal of the near-end user, before transmitting the uplink signal to the far-end user's device during a call. This helps reduce the amount of the near-end user's background noise that might be heard by the far-end user.

Another problem that often appears during a call is that of acoustic echo. A downlink speech signal contains the far-end user's speech. This may be playing through either a loudspeaker (speakerphone mode) or an earpiece speaker of the near-end user's device, and is inadvertently picked up by the primary microphone. This may be due to acoustic leakage within the near-end user's device or, especially in speakerphone mode, it may be due to reverberations from external objects that are near the loudspeaker. An echo cancellation process takes samples of the far-end user's speech from the downlink signal and uses it to reduce the amount of the far-end user's speech that has been inadvertently picked up by the near-end user's microphone, thus reducing the likelihood that the far-end user will hear an echo of his own voice during the call.

Some users of a mobile phone tend to speak softly, whether intentional or not, while others speak loudly. The dynamic range of the speech signal in a mobile device, however, is limited (for practical reasons). In addition, it is generally accepted that one would prefer a fairly steady volume during a conversation with another person. A process known as automatic gain control (AGC) will even out large amplitude variations in the uplink speech signal, by automatically reducing a gain that is applied to the speech signal if the signal is strong, and raising the gain when the signal is weak. In other words, AGC continuously adapts its gain to the strength of its input signal during a call. It may be used separately for both uplink and downlink signals.

To further enhance acoustic experience for the far-end user, AGC of an uplink signal in the near-end user's device is controlled so that its gain is "frozen" during time intervals (also referred to as frames) where the near-user is not speaking and there is apparent silence at the near-end user side of the conversation. Once speech resumes, a decision is made to unfreeze the AGC, thereby allowing it to resume its adaptation of the gain during a speech frame. This is done in order to avoid undesired gain changes or noise amplification during silence frames, which the far-end user might find strange as he hears strongly varying background noise levels during silence frames. A voice activity detector (VAD) circuit or algorithm is used, to determine whether a given frame of the uplink signal is a speech frame or a non-speech (silence) frame, and then on that basis a decision is made as to whether the AGC gain updating for the uplink signal should be frozen or not.

SUMMARY

In accordance with an embodiment of the invention, decisions on whether or not to freeze the AGC gain updating for the uplink signal are made based on the possibility of far-end user speech echo being present in the uplink signal. Thus, a method for performing a call between a near-end user and a far-end user may include the following operations (performed during the call by the near-end user's communications device). A downlink speech signal is received from the far-end user's communications device. An AGC process is performed to update a gain applied to an uplink speech signal, and the gain-updated uplink signal is transmitted to the far-end user's device. A frame in the downlink signal that contains speech is detected, and in response the updating of the gain during a frame in the uplink signal is frozen.

In a further aspect of the invention, the method continues with detecting a subsequent frame in the downlink signal that contains no speech; in response, the updating of the gain is unfrozen during a subsequent frame in the uplink signal.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
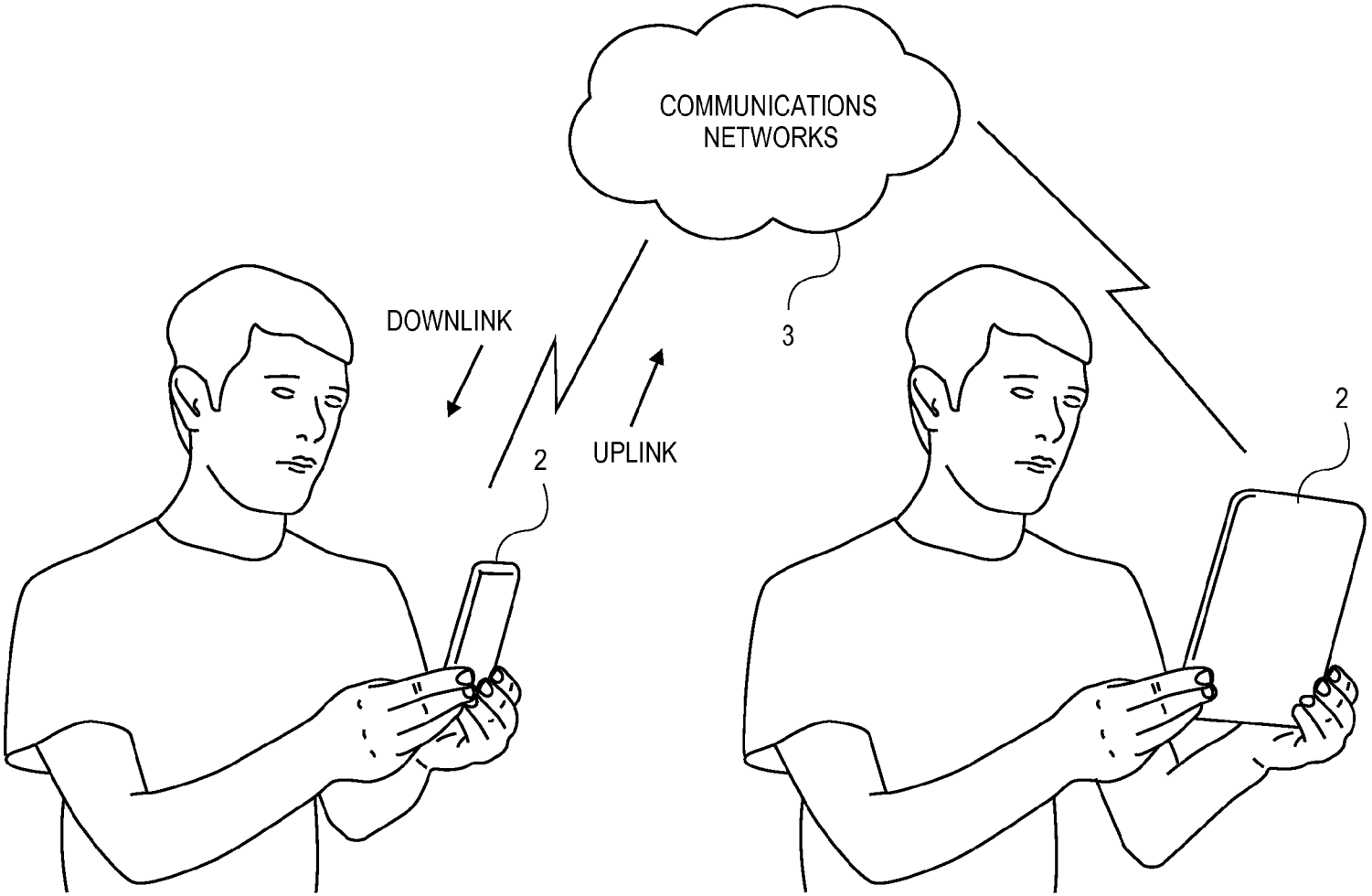
FIG. 1 shows a human user holding different types of a multi-function communications device, namely handheld or mobile devices such as a smart phone and a laptop or notebook computer, during a call.

FIG. 1 shows a human user holding different types of a communications device, in this example a multi-function handheld mobile device referred to here as a personal mobile device 2. In one instance, the mobile device is a smart phone or a multi-function cellular phone, shown in this example as being used in its speakerphone mode (as opposed to against the ear or handset mode). A near-end user is in the process of a call with a far-end user (depicted in this case as using a tablet-like computer also in speakerphone mode). The terms "call" and "telephony" are used here generically to refer to any two-way real-time or live communications session with a far-end user. The call is being conducted through one or more communication networks 3, e.g. a wireless cellular network, a wireless local area network, a wide area network such as the Internet, and a public switch telephone network such as the plain old telephone system (POTS). The far-end user need not be using a mobile device 2, but instead may be using a land-line based POTS or Internet telephony station.

Figure 2:
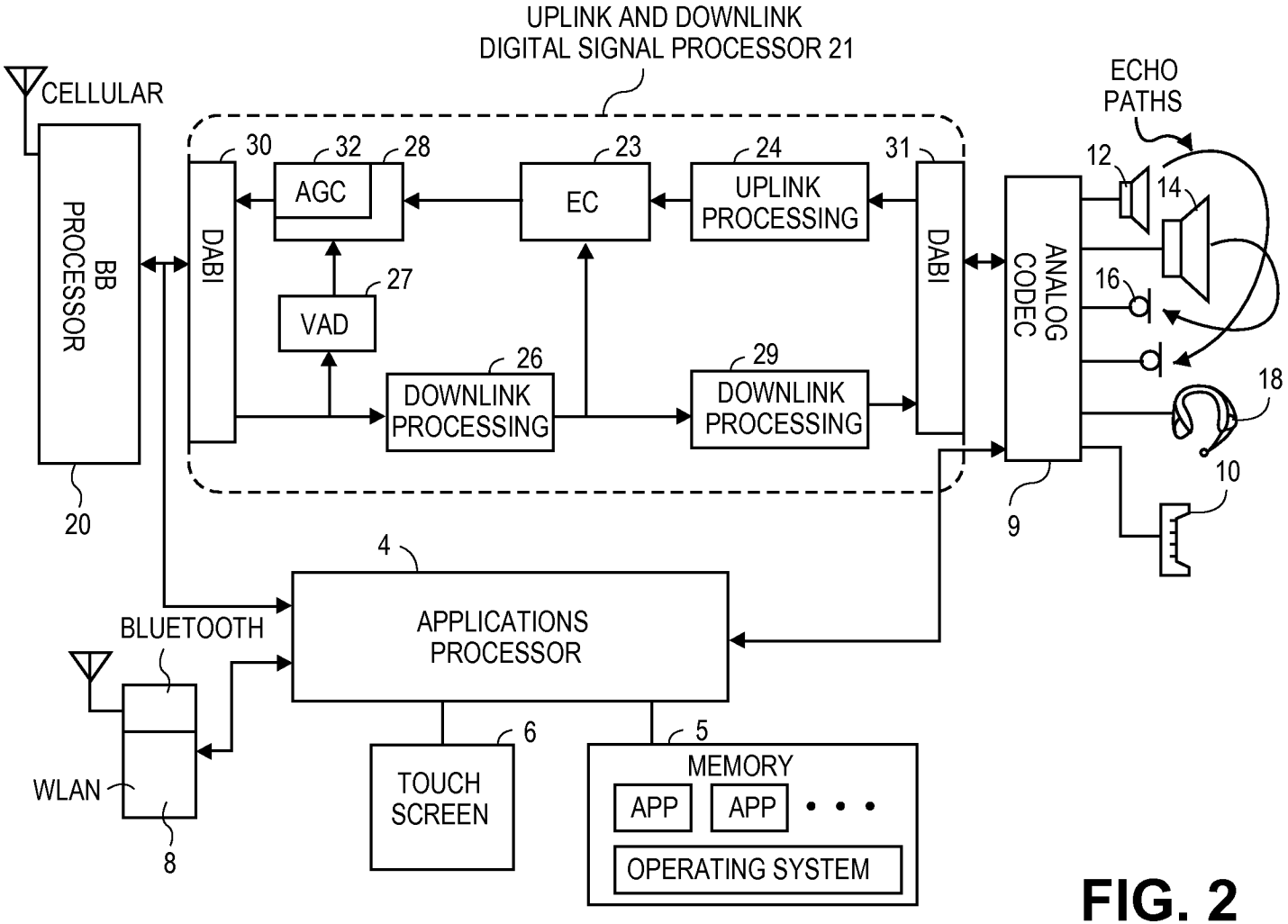
FIG. 2 is a block diagram of some of the functional unit blocks and hardware components in an example communications device.

Turning now to FIG. 2, a functional unit block diagram and some constituent hardware components of the mobile device 2, such as found in, for instance, an iPhone™ device by Apple Inc. are shown. Although not shown, the device 2 has a housing in which the primary mechanism for visual and tactile interaction with its user is a touch sensitive display screen (referred to here as a touch screen 6). As an alternative, a physical keyboard may be provided together with a display-only screen. The housing may be essentially a solid volume, often referred to as a candy bar or chocolate bar type, as in the iPhone™ device. An alternative is one that has a moveable, multi-piece housing such as a clamshell design, or one with a sliding, physical keypad as used by other cellular and mobile handset or smart phone manufacturers. The touch screen 6 displays typical features of visual voicemail, web browser, email, and digital camera viewfinder, as well as telephony features such as a virtual telephone number keypad (which may receive input from the user via virtual buttons and touch commands, as opposed to the physical keyboard option).

The user-level functions of the device are implemented under control of an applications processor 4 that has been programmed in accordance with instructions (code and data) stored in memory 5, e.g. microelectronic, non-volatile random access memory. The processor and memory are generically used here to refer to any suitable combination of programmable data processing components and data storage that can implement the operations needed for the various functions of the device described here. An operating system may be stored in the memory 5, along with application programs to perform specific functions of the device (when they are being run or executed by the processor 4). In particular, there is a telephony application that (when launched, unsuspended, or brought to foreground) enables the near-end user to "dial" a telephone number or address of a communications device of the far-end user to initiate a call using, for instance, a cellular protocol, and then to "hang-up" the call when finished.

For wireless telephony, several options are available in the device depicted in FIG. 2. For instance, a cellular phone protocol may be implemented, using a cellular radio portion that includes a baseband processor 20 together with a cellular transceiver (not shown) and its associated antenna. The baseband processor 20 may be designed to perform various communication functions needed for conducting a call. Such functions may include speech coding and decoding and channel coding and decoding (e.g., in accordance with cellular GSM, and cellular CDMA). As an alternative to a cellular protocol, the device 2 offers the capability of conducting a call over a wireless local area network (WLAN) connection. A WLAN/Bluetooth transceiver 8 may be used for this purpose, with the added convenience of an optional wireless Bluetooth headset link. Packetizing of the uplink signal, and depacketizing of the downlink signal, may be performed by the applications processor 4.

The applications processor 4, while running the telephony application program, may conduct the call by enabling the transfer of uplink and downlink digital audio signals (also referred to here as voice or speech signals) between the applications processor 4 or the baseband processor 20 on the network side, and any user-selected combination of acoustic transducers on the acoustic side. The downlink signal carries speech of the far-end user during a call, while the uplink signal contains speech of the near-end user that has been picked up by the primary microphone. The acoustic transducers include an earpiece speaker 12, a loudspeaker (speakerphone) 14, one or more microphones 16 including a primary microphone that is intended to pick-up the near-end user's speech primarily, and a wired headset 18 with a built-in microphone. The analog-digital conversion interface between these acoustic transducers and the digital downlink and uplink signals is accomplished by an analog codec 9. The latter may also provide coding and decoding functions for preparing any data that is to be transmitted out of the device 2 through a connector 10, and data that is received into the device 2 through the connector 10. This may be a conventional docking connector, used to perform a docking function that synchronizes the user's personal data stored in the memory 5 with the user's personal data stored in memory of an external computing system, such as a desktop computer or a laptop computer.

Still referring to FIG. 2, an uplink and downlink digital signal processor 21 is provided to perform a number of signal enhancement and noise reduction operations upon the digital audio uplink and downlink signals, to improve the experience of both near-end and far-end users during the call. The processor 21 may be a separate integrated circuit die or package, and may have at least two digital audio bus interfaces (DABIs) 30, 31. These are used for transferring digital audio sequences to and from the baseband processor 20, applications processor 4, and analog codec 9. The digital audio bus interfaces may be in accordance with the $I^2S$ electrical serial bus interface specification, which is currently popular for connecting digital audio components and carrying pulse code modulated audio. Various types of audio processing functions may be implemented in the downlink and uplink signal paths of the processor 21.

The downlink signal path receives a downlink digital signal from either the baseband processor 20 or the applications processor 4 (originating as either a cellular network signal or a WLAN packet sequence) through the digital audio bus interface 30. The signal is buffered and is then subjected to various functions (also referred to here as a chain or sequence of functions), including some in downlink processing block 26 and perhaps others in downlink processing block 29. Each of these may be viewed as an audio signal processor. For instance, processing blocks 26, 29 may include one or more of the following: a side tone mixer, a noise suppressor, a voice equalizer, an automatic gain control unit, and a compressor or limiter. The downlink signal as a data stream or sequence is modified by each of these blocks, as it progresses through the signal path shown, until arriving at the digital audio bus interface 31, which transfers the data stream to the analog codec 9 (for playback through the speaker 12, 14, or headset 18).

The uplink signal path of the processor 21 passes through a chain of several audio signal processors, including uplink processing block 24, acoustic echo canceller (EC) 23, and automatic gain control (AGC) block 32. The uplink processing block 24 may include at least one of the following: an equalizer, a compander or expander, and another uplink signal enhancement of noise reduction function. After passing through the AGC block 32, the uplink data sequence is passed to the digital audio bus interface 30 which in turn transfers the data sequence to the baseband processor 20 for speech coding and channel coding prior, or to the applications processor 4 for Internet packetization (prior to being transmitted to the far-end user's device).

The signal processor 21 also includes a voice activity detector (VAD) 26. The VAD 26 has an input through which it obtains the downlink speech data sequence and then analyzes it, looking for time intervals or frames that contain speech (which is that of the far-end user during the call). For instance, the VAD 26 may classify or make a decision on each frame of the downlink sequence that it has analyzed, into one that either has speech or does not have speech, i.e. a silence or pause segment of the far-end user's speech. The VAD 26 may provide, at its output, an identification of this time interval frame together with classification as speech or non-speech.

Echo-Related Decisions on AGC Gain Updating

Still referring to FIG. 2, as explained above, the AGC process will even out large amplitude variations in the uplink speech signal, by automatically reducing a gain that it applies to the speech signal if the signal is strong, and raising the gain when the signal is weak. In other words, AGC block 32 continuously adapts its gain to the strength of its input signal, during a call. Now, assuming the AGC block 32 is active during the call, the signal processor 21 freezes the updating of the gain that is being applied to the uplink signal (by the AGC block 32), during one or more incoming frames of the uplink data sequence that have been determined to be likely to contain some amount of echo of the far-end user's speech. For example, the last gain update computed by the AGC block 32 is applied but kept unchanged during the selected frames.

Figure 3:
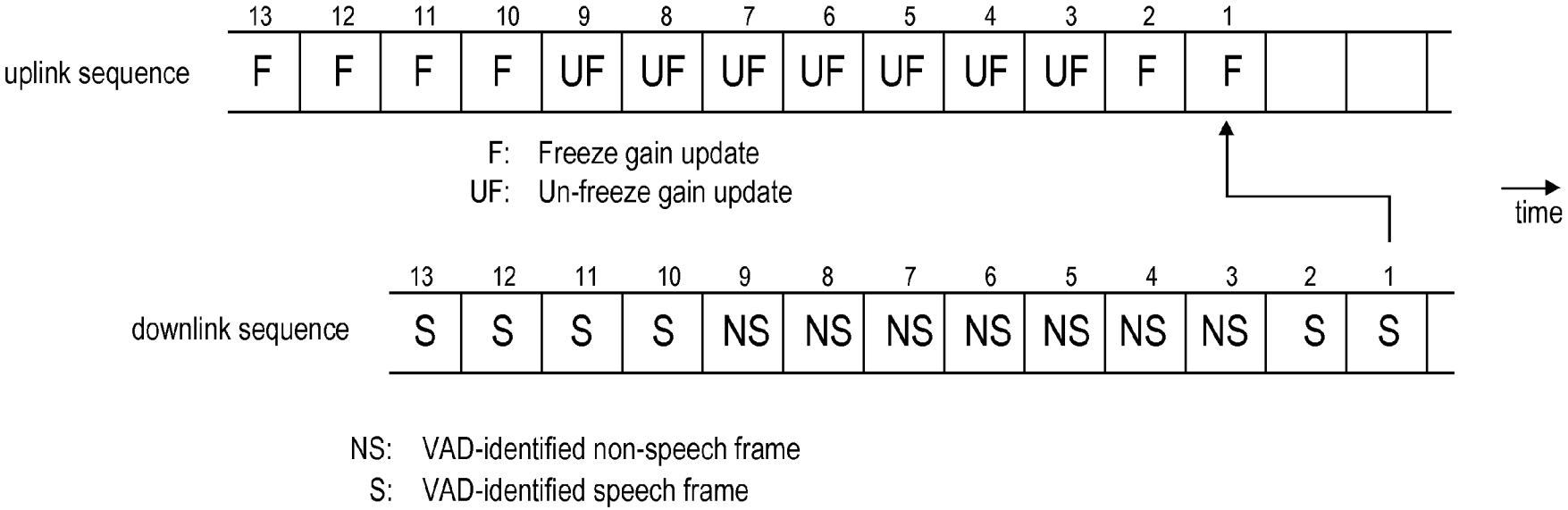
FIG. 3 depicts an example downlink and uplink frame sequence in which gain updating by AGC in the uplink sequence is frozen and unfrozen.

In one embodiment, the decision to freeze (and then unfreeze) is made by a gain update controller 28. The controller 28 may receive from the VAD 27 an identification of a frame that has just been identified as a downlink speech frame. Next, following a predetermined time delay or frame delay in the uplink signal (in response to the indication from the VAD 27), the controller causes the gain updating of the AGC 32 to be frozen during the next incoming frame to the AGC 32. This is depicted in the diagram of FIG. 3. In that example, the delay is two frames, however in general it may be fewer or greater.

In one embodiment, the predetermined delay may be estimated or set in advance, by determining the elapsed time or equivalent number of frames, for sending a given downlink frame through the following path: starting with the VAD 27, then through the downlink signal processing block 29, then through the analog codec 9 and out of a speaker (e.g., earpiece speaker 12 or loudspeaker 14), then reverberating or leaking into the microphone 16, then through the uplink processing block 24, then through the echo canceller 23, and then arriving at the AGC block 32.

If the VAD 27 indicates that it has detected a non-speech (NS) frame, then in response, and optionally after waiting out the predetermined time interval or frame delay in the uplink signal, the gain updating is unfrozen for the next incoming frame to the AGC block 32. The sequence in FIG. 3 depicts the following example: downlink frames 1-2 are Speech frames that result in corresponding uplink frames 1-2 having the applied gain by AGC block 32 frozen; downlink frames 3-9 are Non-Speech frames resulting in corresponding uplink frames 3-9 having the applied gain by AGC block 32 being updated, etc. The "correspondence" between the downlink and uplink frames in this example is a two-frame delay (from the point in the downlink signal at which the speech or non-speech was detected).

While the block diagram of FIG. 2 refers to circuit or hardware components and/or specially programmed processors, the depictions therein may also be used to refer to certain operations of an algorithm or process for performing a call between a near-end user and a far-end user. In one embodiment, the process would include the following digital audio operations performed during the call by the near-end user's communications device: receiving a downlink speech signal from the far-end user's communications device (e.g., in downlink signal processing block 26 or in VAD 27); performing automatic gain control (AGC) to update a gain applied to an uplink speech signal (in AGC block 32) and then transmitting the uplink signal to the far-end user's device (e.g., by a cellular network transceiver associated with the baseband processor 20, or by the WLAN/Bluetooth transceiver 8); and detecting a frame in the downlink signal that contains speech (e.g., by the VAD 27) and in response freezing the updating of the gain during a frame in the uplink signal (by gain update controller 28).

The following additional process operations may be performed during the call:

waiting a predetermined delay (a given time interval or a given number of one or more frames) in response to detecting the frame in the downlink signal, before freezing the updating of the gain (the gain update controller 28 may be programmed at the factory with this delay or it may be dynamically updated during in-the-field use of the device 2);

detecting a subsequent frame in the downlink signal that contains no speech (e.g., by the VAD 27) and in response unfreezing the updating of the gain during a subsequent frame in the uplink signal (VAD 27 indicates the detection to the gain update controller 28 which then responds by allowing gain updates to be applied to the subsequent frame); and waiting a predetermined delay in response to detecting the subsequent frame in the downlink signal, before unfreezing the updating of the gain (the gain update controller 28 may use the same delay as it used before it froze the gain updating).

As explained above, an embodiment of the invention may be a machine-readable medium (such as microelectronic memory) having stored thereon instructions, which program one or more data processing components (generically referred to here as a "processor") to perform the digital domain operations described above including filtering, mixing, adding, subtracting, comparisons, and decision making. In other embodiments, some of these operations might be performed in the analog domain, or by specific hardware components that contain hardwired logic (e.g., dedicated digital filter blocks). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the block diagram of FIG. 2 is for a mobile communications device in which a wireless call is performed, the network connection for a call may alternatively be made using a wired Ethernet port (e.g., using an Internet telephony application that does not use the baseband processor 20 and its associated cellular radio transceiver and antenna). The downlink and uplink signal processors depicted in FIG. 2 may thus be implemented in a desktop personal computer or in a land-line based Internet telephony station having a high speed land-lined based Internet connection. The description is thus to be regarded as illustrative instead of limiting.

What is claimed is:

1. A method for performing a call in a near-end user's communications device, comprising the following operations during the call:

receiving a downlink signal containing speech of a far-end user;

activating automatic gain control (AGC) for an uplink signal containing speech of the near-end user, the AGC to update a gain applied to the uplink signal by automatically reducing the gain where the uplink signal is strong, and raising the gain where the uplink signal is weak;

detecting when the uplink signal contains echo of far-end user speech and in response freezing the updating of the gain; and then unfreezing the updating of the gain in response to detecting the uplink signal contains no far-end user speech echo.

2. The method of claim 1 wherein detecting when the uplink signal contains echo of far-end user speech comprises:

detecting speech in the downlink signal.

3. The method of claim 2 wherein detecting the uplink signal contains no far-end user speech echo comprises:

detecting silence in the downlink signal.

4. The method of claim 1 wherein detecting when the uplink signal contains echo of far-end user speech comprises identifying a frame in the downlink signal that contains speech, wherein the gain updating is frozen during a corresponding frame in the uplink signal.

5. The method of claim 4 wherein the corresponding frame in the uplink signal is one that contains echo of the speech in the identified frame in the downlink signal.

6. The method of claim 4 further comprising:

in response to the frame in the downlink signal being identified, waiting a predetermined delay until the start of the corresponding frame in the uplink signal.

7. A communications device comprising:

a downlink signal processor to process a downlink audio signal received from a far-end user's communications device, the downlink signal causes speech of the far-end user to be heard by the near-end user from a speaker;

an uplink signal processor to process an uplink audio signal picked up by a microphone and to be transmitted to the far-end user's device, the uplink signal processor having an automatic gain control (AGC) block that is to even out large amplitude variations in the uplink audio signal;

a voice activity detector (VAD) to detect a speech frame in the downlink audio signal; and a gain update controller having an input coupled to an output of the VAD to receive indication of a detected downlink speech frame and in response make a decision to freeze gain updating by the AGC block.

8. The device of claim 7 wherein the VAD is to detect a non-speech frame in the downlink audio signal, and the gain update controller is to receive indication of the detected downlink non-speech frame and in response make a decision to un-freeze the gain updating by the AGC block.

9. The device of claim 7 wherein the downlink processor comprises a chain of audio signal processors including at least one of the group consisting of a noise suppresser, a voice equalizer, and an automatic gain control unit.

10. The device of claim 7 wherein the uplink processor comprises a chain of audio signal processors including at least one of the group consisting of an equalizer, an acoustic echo canceller, and a compander or expander.

11. A method for performing a call between a near-end user and a far-end user, the method comprising the following operations performed during the call by the near-end user's communications device:

receiving a downlink speech signal from the far-end user's communications device;

performing automatic gain control (AGC) to update a gain applied to an uplink speech signal by automatically reducing the gain where the uplink speech signal is strong, and raising the gain where the uplink speech signal is weak and then transmitting the uplink signal to the far-end user's device; and detecting a frame in the downlink signal that contains speech and in response freezing the updating of the gain during a frame in the uplink signal.

12. The method of claim 11 further comprising:

waiting a predetermined delay in response to detecting the frame in the downlink signal, before freezing the updating of the gain.

13. The method of claim 11 further comprising:

detecting a subsequent frame in the downlink signal that contains no speech and in response unfreezing the updating of the gain during a subsequent frame in the uplink signal.

14. The method of claim 13 further comprising:

waiting a predetermined delay in response to detecting the subsequent frame in the downlink signal, before unfreezing the updating of the gain.

* * * * *